US011293070B2

(12) United States Patent
Terashima et al.

(10) Patent No.: US 11,293,070 B2
(45) Date of Patent: Apr. 5, 2022

(54) GRAIN-ORIENTED ELECTRICAL STEEL SHEET

(71) Applicant: JFE STEEL CORPORATION, Tokyo (JP)

(72) Inventors: Takashi Terashima, Tokyo (JP); Takumi Umada, Tokyo (JP); Makoto Watanabe, Tokyo (JP); Toshito Takamiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 207 days.

(21) Appl. No.: 16/483,829

(22) PCT Filed: Jan. 17, 2018

(86) PCT No.: PCT/JP2018/001270
§ 371 (c)(1),
(2) Date: Aug. 6, 2019

(87) PCT Pub. No.: WO2018/150791
PCT Pub. Date: Aug. 23, 2018

(65) Prior Publication Data

US 2020/0010917 A1 Jan. 9, 2020

(30) Foreign Application Priority Data

Feb. 17, 2017 (JP) ..... 2017-028249

(51) Int. Cl.
*C21D 8/12* (2006.01)
*C22C 38/00* (2006.01)
*H01F 1/16* (2006.01)

(52) U.S. Cl.
CPC ..... *C21D 8/12* (2013.01); *C22C 38/00* (2013.01); *H01F 1/16* (2013.01)

(58) Field of Classification Search
CPC ..... C21D 8/12; C22C 38/00
USPC ..... 148/306
See application file for complete search history.

(56) References Cited

U.S. PATENT DOCUMENTS 4,293,350 A 10/1981 Tadashi et al.

FOREIGN PATENT DOCUMENTS

| | | | | |
|---|---|---|---|---|
| EP | 0870843 A1 * | 10/1998 | ..... | C21D 8/1294 |
| EP | 0870843 A1 | 10/1998 | | |
| EP | 2799579 A1 | 11/2014 | | |
| JP | S5518566 A | 2/1980 | | |

(Continued)

OTHER PUBLICATIONS

Apr. 3, 2018, International Search Report issued in the International Patent Application No. PCT/JP2018/001270.

(Continued)

*Primary Examiner* — Weiping Zhu
(74) *Attorney, Agent, or Firm* — Kenja IP Law PC

(57) ABSTRACT

In a grain-oriented electrical steel sheet, comprising magnetic domains refined by a plurality of linear grooves in a surface of a steel sheet, each of the linear grooves is provided on its floor with a plurality of recessed parts aligned in a direction in which the linear groove extends, at a predetermined interval p (μm), and the recessed part is made to have a predetermined depth d (μm). In this way, it is possible to provide a grain-oriented electrical steel sheet having further improved iron loss properties while having reduced magnetic flux density reduction.

16 Claims, 4 Drawing Sheets

(56) References Cited

FOREIGN PATENT DOCUMENTS

| | | | |
|---|---|---|---|
| JP | S6267114 | A | 3/1987 |
| JP | S6342332 | A | 2/1988 |
| JP | H07220913 | A | 8/1995 |
| JP | 2005059014 | A | 3/2005 |
| JP | 4719319 | B2 | 7/2011 |
| JP | 2012102395 | A | 5/2012 |
| JP | 2013510239 | A | 3/2013 |
| WO | 9724466 | A1 | 7/1997 |
| WO | 2010147009 | A1 | 12/2010 |

OTHER PUBLICATIONS

Oct. 24, 2019, the Extended European Search Report issued by the European Patent Office in the corresponding European Patent Application No. 18754457.2.

* cited by examiner

GRAIN-ORIENTED ELECTRICAL STEEL SHEET

TECHNICAL FIELD

The disclosure relates to a grain-oriented electrical steel sheet advantageously utilized for an iron core of a transformer, in particular of a winding transformer.

BACKGROUND

A grain oriented electrical steel sheet is mainly utilized as an iron core of a transformer and required to have excellent magnetization properties, in particular low iron loss. In this regard, it is important to highly accord secondary recrystallized grains of a steel sheet with (110)[001] orientation (Goss orientation), and reduce impurities in a product steel sheet.

However, there are limits on controlling crystal grain orientations and reducing impurities. Accordingly, various developments have been made for a technique of subdividing a magnetic domain by physical means to reduce iron loss, i.e. a magnetic domain refining technique. The magnetic domain refining technique is roughly classified into non-heat resistant techniques and heat resistant techniques. A winding transformer requires a heat resistant magnetic domain refining technique in order to process a steel sheet into an iron core and subsequently subject it to stress relief annealing.

As a non-heat resistant magnetic domain refining technique, JP S55-18566 A (PTL 1) discloses a technique of irradiating a steel sheet after final annealing with a laser to introduce linear strain regions in the steel sheet surface layer. As a heat resistant magnetic domain refining technique, a method of forming grooves in a steel sheet surface is generally used. Specifically, JP S62-067114 A (PTL 2) discloses a method of mechanically pressing a tooth mark on a steel sheet to form grooves. JP S63-042332 A (PTL 3) discloses a method of forming grooves by etching. JP H07-220913 A (PTL 4) discloses a method of forming grooves by a laser.

The magnetic domain refining technique by forming grooves has a small iron loss reduction effect and low magnetic flux density as compared with the magnetic domain refining technique of introducing high dislocation density regions with, for example, a laser. In order to improve these problems, improvements are proposed on the groove formation method. For example, JP 4719319 B (PTL 5) discloses an improvement of a steel sheet surface shape. JP 5771620 B (PTL 6) discloses an improvement of a groove shape.

CITATION LIST

Patent Literatures

PTL 1: JP S55-18566 A
PTL 2: JP S62-067114 A
PTL 3: JP S63-042332 A
PTL 4: JP H07-220913 A
PTL 5: JP 4719319 B
PTL 6: JP 5771620 B

SUMMARY

Technical Problem

The heat resistant magnetic domain refining technique by forming grooves reduces a steel substrate in proportion to the volume of grooves to be formed. Accordingly, deepening grooves to enhance a magnetic domain refining effect reduces magnetic flux density. The same applies to the techniques disclosed in PTL 5 and PTL 6. The conventional techniques are thus problematic in that an effect is limited which is obtained under a balance between magnetic flux density reduction and a magnetic domain refining effect enhancement.

It could thus be helpful to provide a grain-oriented electrical steel sheet having further improved iron loss properties while having reduced magnetic flux density reduction, by improving a linear groove shape in a depth direction.

Solution to Problem

We repeated experiments of forming various grooves in grain-oriented electrical steel sheets having the same properties before magnetic domain refining. During the experiments, we discovered grain-oriented electrical steel sheets which exhibit a significant improvement in iron loss properties relative to magnetic flux density reduction among steel sheets with grooves which have an unsmooth and rough floor. We then examined those steel sheets in detail to thereby discover an optimum groove floor shape. Thus, we have accomplished the disclosure.

We thus provide:

1. A grain-oriented electrical steel sheet, comprising magnetic domains refined by a plurality of linear grooves in a surface of a steel sheet, wherein each of the linear grooves has on its floor a plurality of recessed parts aligned in a direction in which the linear groove extends, at an interval p (μm) which satisfies the following Formula (1):

$$0.20\ W \leq p \leq 1.20\ W \quad (1),$$

where W is an opening width of the linear groove (μm), and wherein the recessed part has a depth d (μm) which satisfies the following Formula (2):

$$0.10\ D \leq d \leq 1.00\ D \quad (2),$$

where D is an average depth of the linear groove (μm).

2. The grain-oriented electrical steel sheet according to 1, wherein the average depth D (μm) of the linear groove satisfies the following Formula (3):

$$0.05\ t \leq D \leq 0.20\ t \quad (3),$$

where t is a steel sheet thickness (μm).

3. The grain-oriented electrical steel sheet according to 1 or 2, wherein the direction in which the linear groove extends forms an angle of 0° or more and 40° or less with a direction orthogonal to a rolling direction of the steel sheet.

4. The grain-oriented electrical steel sheet according to 1, 2, or 3, wherein the linear grooves have a mutual interval 1 (μm) in the rolling direction of the steel sheet which satisfies the following Formula (4):

$$10\ W \leq 1 \leq 400\ W \quad (4),$$

where W is an opening width of the linear groove (μm).

5. The grain-oriented electrical steel sheet according to any of 1 to 4, wherein the opening width W of the linear groove is 5 μm or more and 150 μm or less.

Advantageous Effect

According to the disclosure, it is possible to reduce magnetic flux density reduction in a grain-oriented electrical steel sheet having improved iron loss properties by virtue of a magnetic domain refining effect through forming grooves in a surface of the steel sheet.

BRIEF DESCRIPTION OF THE DRAWINGS

In the accompanying drawings.

DETAILED DESCRIPTION

Detailed description is given below.

When a groove is formed, a 180° magnetic domain wall is newly generated to narrow a magnetic domain width in order to prevent magnetostatic energy from increasing due to magnetic poles generated on the groove side surfaces, which enables heat resistant magnetic domain refining. When a magnetic domain width is thus narrowed, a magnetic domain wall displacement distance is shortened in steel sheet magnetization, thus reducing energy loss in domain wall displacement, i.e., reducing iron loss.

The mechanism of the iron loss reduction requires magnetic pole generation. Therefore, it is essential to form interfaces of materials which have different magnetic permeability.

The technique of forming grooves uses iron and air as the materials having different magnetic permeability. Therefore, a space is just formed equivalent to the volume of the grooves, thus reducing effective magnetic permeability of a steel sheet to reduce magnetic flux density $B_8$ value in magnetization at 800 A/m which denotes an index of magnetic properties.

Accordingly, when many magnetic poles are generated to enhance a magnetic domain refining effect, magnetic flux density is reduced, which incurs a dilemma. Further, magnetic poles are generated only in groove side surfaces; therefore, forming grooves in a surface (one side surface) of a steel sheet cannot exert a groove formation effect in a center part in thickness direction or the rear surface (the other side surface) of the steel sheet.

We conducted extensive examination as to a groove floor shape which maximizes the effect by groove formation. We consequently discovered that forming recessed parts in a floor of a linear groove is effective which satisfy predetermined conditions. That is, we discovered that forming a plurality of recessed parts aligned at a predetermined interval in a floor of a linear groove and providing the recessed parts with a predetermined depth is optimum to obtain a magnetic domain refining effect by groove formation.

Figure 1:
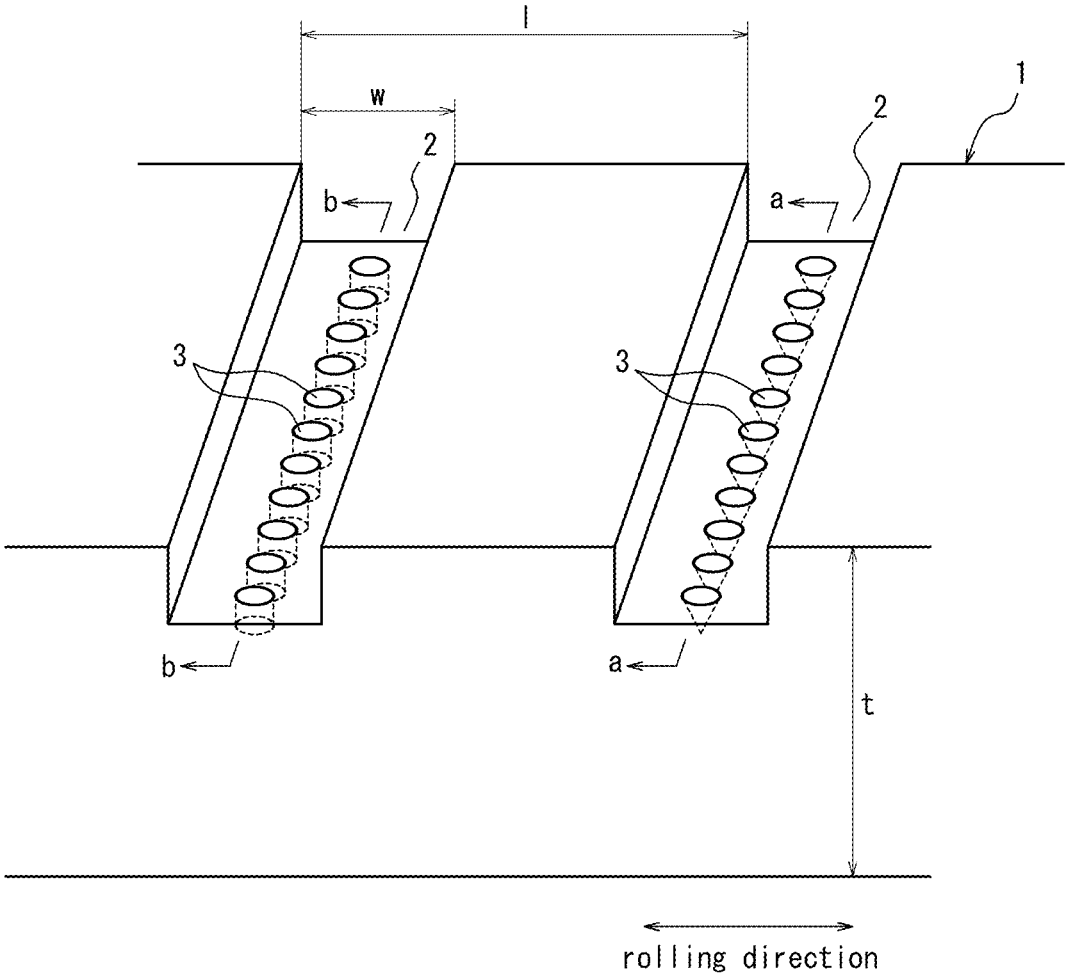
FIG. 1 is a perspective view illustrating a steel sheet having linear grooves on its surface.
Figure 2A:
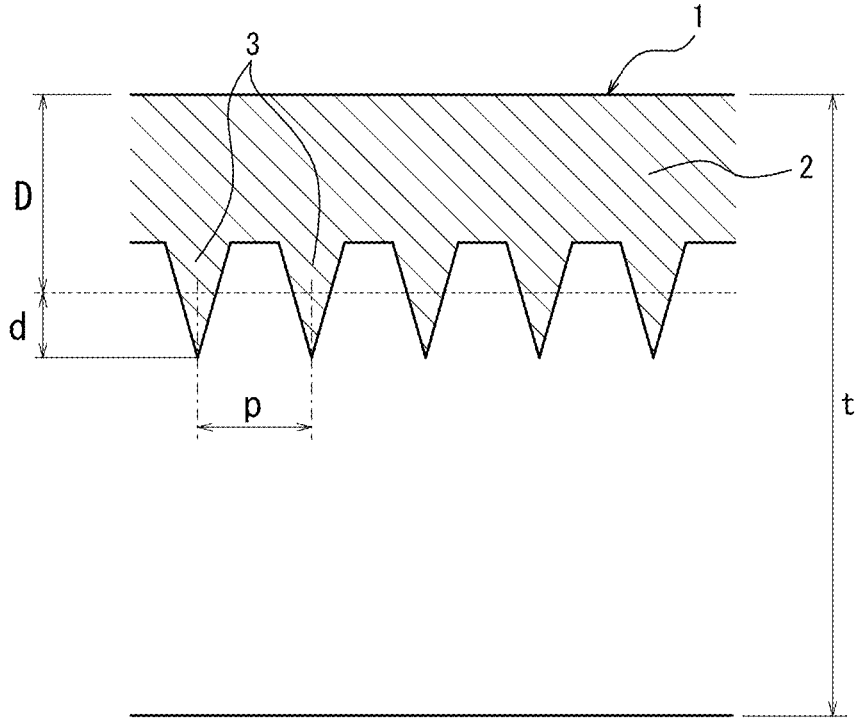
FIG. 2A is a schematic view illustrating a linear groove shape.
Figure 2B:
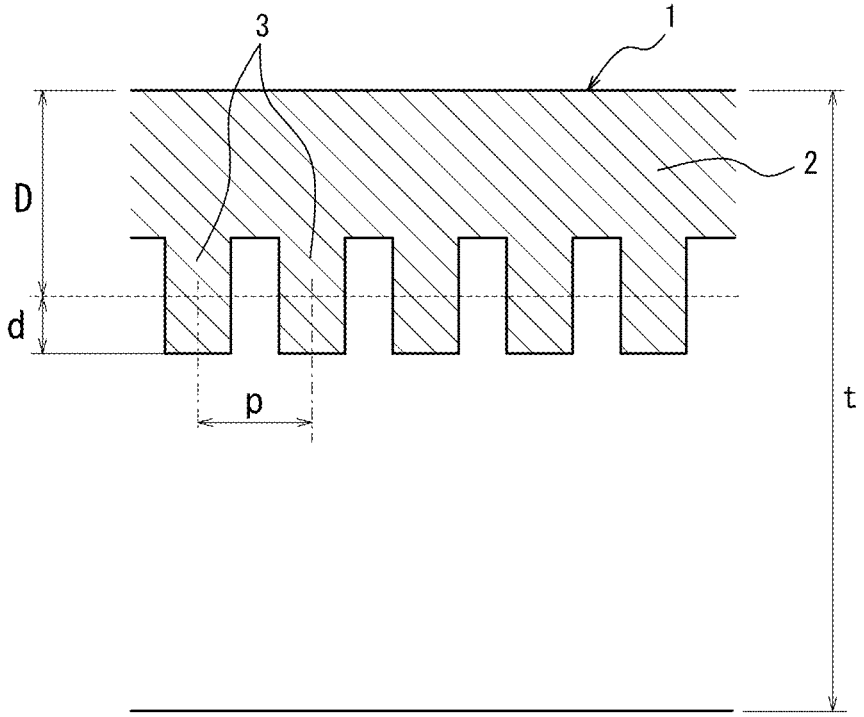
FIG. 2B is a schematic view illustrating a linear groove shape.
Figure 3:
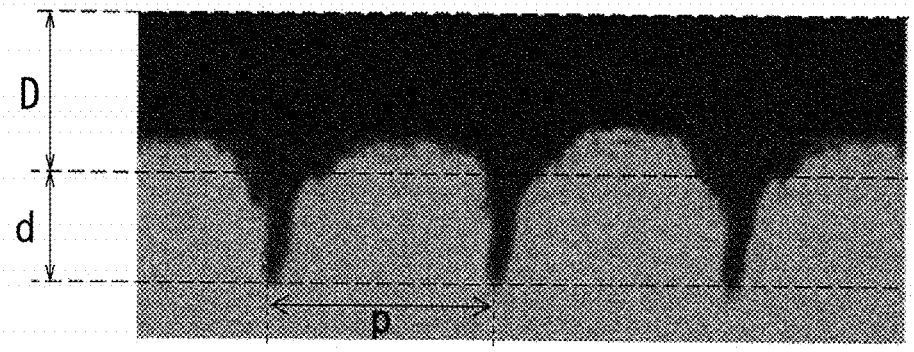
FIG. 3 is an electron microscope (SEM) photograph illustrating a cross-sectional shape of a linear groove (D=20 μm, d=15 μm, p=30 μm).

Specifically, as illustrated in FIG. 1, linear grooves 2 extending in a direction crossing a rolling direction of steel sheet 1 and formed at an interval in the rolling direction are provided with a plurality of recessed parts 3 on their floors in the direction in which the grooves 2 extend. The recessed part 3 may have a conical-shaped cross-section taken along the a-a line as illustrated in FIG. 2A and FIG. 3, and have a cylindrical-shaped cross-section taken along the b-b line as illustrated in FIG. 2B. Otherwise, the recessed parts may have any different shapes as long as they have the interval p satisfying the following Formula (1) and the depth d (μm) satisfying the following Formula (2). In FIG. 1, for convenience of explanation, the shapes of the recessed parts are different for each groove, but the same-shaped recessed parts are preferably formed in all linear grooves in terms of manufacturability.

When recessed parts 3 are thus formed on the floor of linear groove 2, new magnetic poles are generated inside of the steel sheet, though the number of them is smaller than that of magnetic poles generated in a surface of the steel sheet. Magnetic domain walls tend to be generated in a direction in which inside energy thereof is minimized, that is, in a direction perpendicular to the surface of the steel sheet toward the rear side of the steel sheet. Accordingly, even though the smaller number of magnetic poles is generated inside the steel sheet, the magnetic domain walls are generated straight to the inside of the steel sheet, and thus the magnetic domain refining effect is not so reduced as compared with the reduction in the number of the magnetic poles generated inside of the steel sheet relative to the number of magnetic poles on the surface of the steel sheet. Consequently, a greater magnetic domain refining effect can be achieved than in a conventional uniform-deep groove having the same cross-sectional area.

Means different from the disclosure include a method of linearly aligning dot-like holes which penetrate the whole thickness of a steel sheet to generate magnetic poles under conditions of having a constant cross-sectional area. This form, however, has no groove between the holes, thus not exerting a magnetic domain refining effect. If the cross-sectional area is constant, a refining effect is rather enhanced when the steel sheet has grooves of the same depth in its surface. Therefore, in the disclosure, grooves of the same depth are formed in a surface of the steel sheet and recessed parts regarded as a part of the deep groove are formed in the groove floors, thereby producing a more excellent magnetic domain refining effect.

Reasons for limitations on the features of the disclosure will be explained below.

It is important in the disclosure that a linear groove has on its floor a plurality of recessed parts aligned in a direction in which the linear groove extends at an interval p which satisfies the following Formula (1):

$$0.20\ W \leq p \leq 1.20\ W \quad (1),$$

where W is an opening width of the linear groove, and the recessed part has a depth d which satisfies the following Formula (2):

$$0.10\ D \leq d \leq 1.00\ D \quad (2),$$

where D is an average depth of the linear groove.

In the disclosure, the unit of p, d, W, and D is (μm).

The interval p of the recessed parts is determined as follows. A cross-section taken along a direction in which the linear groove extends (the a-a line cross-section in FIG. 1) is observed along a 1 mm length thereof by an optical microscope or electron microscope to measure the number of the recessed parts which are aligned at the position of the below-mentioned average depth D (the dotted line position in FIG. 2) and divide 1 mm by the number. This measurement is conducted at three arbitrary places and an average thereof is the interval p. W is an opening width of the linear groove in a surface of the steel sheet.

The depth d of the recessed part is determined as follows. A cross-section taken along a direction in which the linear groove extends (the a-a line cross-section in FIG. 1) is observed along a 1 mm length thereof by an optical microscope or electron microscope to subtract the average depth D of the linear groove from an average depth of the deepest part of each recessed part.

The average depth D of the groove is determined as follows. A cross-section taken along a direction in which the linear groove extends (the a-a line cross-section in FIG. 1) is observed along a 1 mm length thereof by an optical microscope or electron microscope to measure a cross-sectional area of the grooves comprising the recessed parts (the hatched part in FIG. 2) and divide the cross-sectional area by 1 mm. The cross-section to be measured is a cross-section passing through the center of the groove in the rolling direction.

As mentioned above, the interval p of the recessed parts is required to be 0.20 W or more and 1.20 W or less, where W is an opening width of the linear groove. That is, in the case that the interval p of the recessed parts is less than 0.20 W, the effect of forming recessed parts is not produced. In other words, in such a case, the grooves are the same as conventional ones with the constant depth, which makes it difficult to significantly improve a magnetic domain refining effect. Also in the case that the interval p is more than 1.20 W, the interval is too wide to significantly improve a magnetic domain refining effect.

Figure 4:
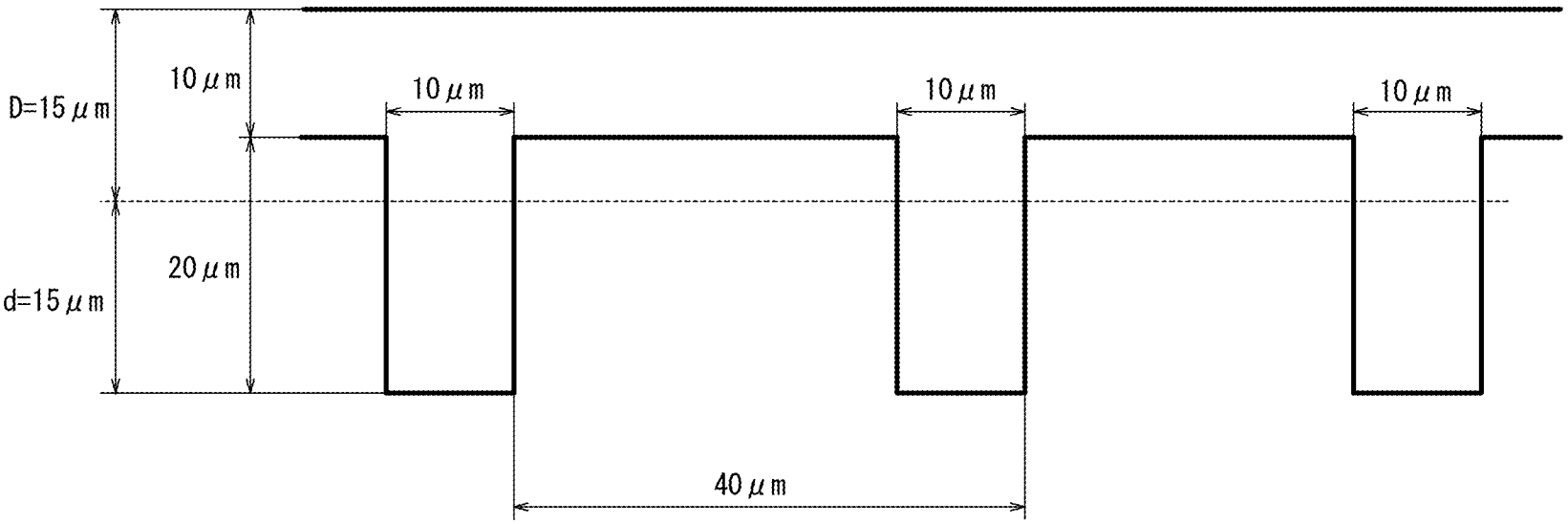
FIG. 4 is a schematic view illustrating an example of a linear groove shape in the case of d=1.00 D.

The depth d of the recessed part is required to be 0.10 D or more and 1.00 D or less. In the case that the depth of the recessed part is less than 0.10 D, a magnetic domain refining effect cannot be obtained in the aforementioned center part in sheet thickness direction. In the case that the depth of the recessed part is more than 1.00 D, a magnetic domain refining effect is increased. The steel sheet, however, has decreased magnetic permeability to cause increase in iron loss in excitation to high magnetic flux density. Accordingly, the depth of the recessed part is required to be 1.00 D or less. For example, in the case that the recessed part has a sectional shape as illustrated in FIG. 4, d is 1.00 D.

FIG. 1 and FIG. 2 each illustrate an example of conical-shaped or cylindrical-shaped recessed parts 3, but the shape is not limited to those two and the recessed part may have, for example, an elliptical cone shape and an ellipse cylinder shape as well as a square pillar shape and a pyramidal shape. In summary, it suffices for the interval p to satisfy the above-mentioned Formula (1) and for the depth d to satisfy the above-mentioned Formula (2).

The (average) depth D of the linear groove preferably satisfies the following Formula (3):

$$0.05\ t \leq D \leq 0.20\ t \quad (3)$$

where t is a steel sheet thickness, the steel sheet thickness t being a sheet thickness of a part without any groove (the unit of t is mm in the disclosure, but in the case of applying to the above-mentioned formula, the unit is converted to μm).

In the case that the (average) depth D of the linear groove is less than 0.05 t, the depth of the groove is so small relative to the thickness of the steel sheet that a magnetic domain refining effect may not be produced. In the case that the (average) depth D is more than 0.20 t, a magnetic domain refining effect is increased, but the magnetic permeability of the steel sheet is reduced to possibly cause increase in iron loss in excitation to high magnetic flux density. Accordingly, D is preferably 0.20 t or less.

Further, the direction in which the linear groove extends preferably forms an angle of 0° or more and 40° or less with a direction orthogonal to the rolling direction of the steel sheet. That is, the size of magnetic pole depends on an angle of a direction in which a magnetic flux flows with a groove side surface. In a grain-oriented electrical steel sheet, an angle 0° generates the biggest size of magnetic pole. The larger angle results in a smaller size of magnetic pole, and thus the angle is preferably about 40° or less. The angle is more preferably 30° or less.

A mutual interval 1 of the linear grooves in the rolling direction of the steel sheet (see FIG. 1 (the unit of 1 is μm)) preferably satisfies the following Formula (4):

$$10\ W \leq 1 \leq 400\ W \quad (4),$$

where W is an opening width of the linear groove.

That is, in the case that the interval 1 of the linear grooves is less than 10 W, the number of grooves formed per unit length is increased to thereby enhance a magnetic domain refining effect. Such groove forming, however, takes time to incur higher cost. In the case that the interval 1 is more than 400 W, the number of grooves is reduced to increase productivity, but a magnetic domain refining effect is reduced.

The opening width W of the linear groove is preferably 5 μm or more and 150 μm or less. That is, the smaller opening width W of the linear groove is effective for magnetic domain refining, but processing grooves in a surface of the steel sheet with a width less than 5 μm requires an extremely expensive processing method, which is disadvantageous in productivity and process cost. Processing becomes easier as the groove width increases, but even if the width is more than 150 μm, productivity and process cost are less likely to be improved.

In FIG. 1, the linear groove 2 has a rectangular-shaped cross-section which is orthogonal to the direction in which the linear groove 2 extends, but the shape is not limited to be rectangular and the linear groove 2 may have a gutter-shaped cross-section which floor makes continuous circular arcs.

A method of forming grooves in a grain-oriented electrical steel sheet according to the disclosure is not particularly limited. Some specific examples of the groove formation method are described below.

Etching Method 1

Etching method 1 is a method of forming a resist mask on a surface of a grain-oriented electrical steel sheet after final cold rolling and subsequently forming grooves with a shape according to the disclosure in a surface of the steel sheet by electrolytic etching.

In order to achieve a groove shape according to the disclosure, the mask formation and the etching each need to be repeated twice. That is, in the first stage, a resist mask is formed on a steel sheet and etched so that the steel sheet is exposed at parts corresponding to recessed parts in a dot pattern with a desired interval. Then, the resist mask is removed. In the second stage, a mask is newly formed on the steel sheet and etched so that the steel sheet is linearly exposed. Thus, the two-stage processing enables to form a groove shape according to the disclosure.

In view of an effect of D including a part of a recessed part, the second etching (determination of D) needs to be conducted so as to satisfy the disclosure. Further, the parts corresponding to recessed parts formed in the first etching have an upper side removed in the second etching. Therefore, in view of such removing, the parts corresponding to recessed parts need to be shaped in the first etching so that the recessed parts have a shape as disclosed after the second etching. The formation of a resist mask is conducted by, for example, gravure printing and ink jet printing. Etching can be conducted by chemical etching which uses acid or electrolytic etching which uses a NaCl aqueous solution.

Etching Method 2

Etching method 2 is a method which uses a grain-oriented electrical steel sheet after final annealing on which a forsterite film is formed. This method uses the forsterite film as a resist mask instead of an expensive etching resist and has no need of a resist peeling process. This method also requires two-stage processing as with etching method 1. In the first stage, a fiber laser, etc. is applied to the forsterite film to peel the film in a dot line pattern. Then, the steel sheet is etched. Subsequently, the film is peeled in a linear pattern using, for example, a fiber laser. Then, the steel sheet is subjected to a second etching processing. Etching can be conducted in the same way as in etching method 1. As mentioned in the foregoing paragraph, the recessed part shape after the second etching processing is important.

Laser Direct Engraving Method

An etching method needs two-stage processing, thus incurring high process cost. Therefore, grooves are directly formed using a short pulse laser (picosecond laser or femtosecond laser).

A grain-oriented electrical steel sheet after final annealing is easily processed and preferable to use. Generally, an optimum laser output is different between forsterite (ceramics) and steel (steel substrate) (ceramics processing requires higher output); however, it is preferable to process a steel substrate part with high output optimized for ceramics because a desired groove shape and recessed part shape can be easily formed with a pitch in proportion to a pulse interval and laser scanning rate.

Lastly, in manufacturing a grain-oriented electrical steel sheet according to the disclosure, conditions other than the above are not particularly limited, but recommended and preferred chemical compositions and manufacturing conditions other than the above will be described below.

In the disclosure, when an inhibitor is to be used, the chemical composition may contain appropriate amounts of Al and N in the case that an A1N-based inhibitor is utilized or appropriate amounts of Mn and Se and/or S in the case that a MnS·MnSe-based inhibitor is utilized. Of course, both inhibitors may be used in combination. When inhibitors are used as described above, contents of Al, N, S and Se in the chemical composition are preferably Al: 0.01 mass % to 0.065 mass %, N: 0.005 mass % to 0.012 mass %, S: 0.005 mass % to 0.03 mass %, Se: 0.005 mass % to 0.03 mass %. These inhibitor components are removed from a steel sheet (steel substrate) after final annealing, and the contents thereof will be as low as an impurity content level.

The present disclosure is also applicable to a grain-oriented electrical steel sheet having limited contents of Al, N, S and Se basically without using an inhibitor. In such a case, the contents of Al, N, S and Se are preferably limited to Al: 100 mass ppm or less, N: 50 mass ppm or less, S: 50 mass ppm or less, and Se: 50 mass ppm or less.

Other basic components and optionally added components are as follows.

C: 0.08 mass % or less

If the C content exceeds 0.08 mass %, it becomes difficult to reduce the content to 50 mass ppm or less that causes no magnetic aging in a product during the manufacturing process. Therefore, the C content is preferably 0.08 mass % or less. It is not necessary to set a particular lower limit on the C content, because secondary recrystallization can be caused even with a material not containing C.

Si: 2.0 mass % to 8.0 mass %

Si is an element that is useful for increasing electrical resistance of steel and improving iron loss properties. However, if the content thereof is less than 2.0 mass %, a sufficient effect of reducing iron loss is not achieved. If the Si content exceeds 8.0 mass %, formability significantly deteriorates and magnetic flux density is reduced as well. Therefore, the Si content is preferably in a range of 2.0 mass % to 8.0 mass %.

Mn: 0.005 mass % to 1.0 mass %

Mn is an element which is necessary for improving hot workability. However, if the content thereof is less than 0.005 mass %, the addition effect is limited. If the Mn content exceeds 1.0 mass %, the magnetic flux density of a product sheet is reduced. Therefore, the Mn content is preferably in a range of 0.005 mass % to 1.0 mass %.

In addition to the above basic components, the following elements may be contained as appropriate, as elements for improving magnetic properties.

At least one selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %

Ni is a useful element which improves the structure of a hot-rolled sheet to enhance magnetic properties. However, if the Ni content is less than 0.03 mass %, it is less effective for improving magnetic properties. If it exceeds 1.50 mass %, secondary recrystallization becomes unstable and magnetic properties deteriorate. Therefore, the Ni content is preferably in a range of 0.03 mass % to 1.50 mass %.

Further, Sn, Sb, Cu, P, Mo, and Cr are each useful elements in terms of improving magnetic properties. However, if the contents of these elements are lower than the respective lower limits described above, the magnetic properties-improving effect is limited. If the contents of these elements exceed the respective upper limits described above, the growth of secondary recrystallized grains is inhibited. Therefore, the elements are preferably contained within their respective ranges described above. The balance other than the above-described elements includes Fe and inevitable impurities that are incorporated during the manufacturing process.

A steel material adjusted to the above preferable chemical composition may be formed into a slab by normal ingot casting or continuous casting, or a thin slab or thinner cast steel with a thickness of 100 mm or less may be manufactured by direct continuous casting. The slab is subjected to heating and subsequent hot rolling in a conventional manner. The slab may be subjected to hot rolling directly after casting without heating. In the case of a thin slab or thinner cast steel, it may be subjected to hot rolling or directly proceed to subsequent steps, omitting hot rolling. After performing hot band annealing as necessary, the material is formed as a cold-rolled sheet with the final sheet thickness by cold rolling once, or twice or more with intermediate annealing therebetween. Subsequently, after subjecting the cold-rolled sheet to decarburization annealing and then final annealing, an insulating tension coating is generally applied to the sheet to yield a product.

EXAMPLE 1

Steel slabs, each containing, in mass %, Si: 3.3%, C: 0.06%, Mn: 0.08%, S: 0.001%, Al: 0.015%, N: 0.006%, Cu:

0.05%, and Sb: 0.01% were heated at 1100° C. for 30 minutes, and then subjected to hot rolling to obtain hot-rolled sheets with a sheet thickness of 2.2 mm. Then, the hot-rolled sheets were subjected to hot band annealing under conditions of 1000° C.×1 minute, then cold rolling to obtain steel sheets with a final sheet thickness of 0.23 mm. The steel sheets were then heated from room temperature to 820° C. at the heating rate of 20° C./s and subjected to primary recrystallization annealing (also serving as decarburization) in a wet atmosphere. Subsequently, an annealing separator in a water slurry state mainly composed of MgO was applied to the steel sheets and dried. The steel sheets were further subjected to final annealing of heating from 300° C. to 800° C. for 100 hours, then heating to 1200° C. at the heating rate of 50° C./h, and subjecting to annealing for 5 hours at 1200° C. Then a silicophosphate-based insulation tension coating containing a composition of magnesium phosphate (as $Mg(PO_3)_2$): 30 mol %, colloidal silica (as $SiO_2$): 60 mol %, Cr03: 10 mol% was applied to the steel sheets and baked under conditions of 850° C.×1 minute. The steel sheets thus obtained were sheared into a size of 300 mm in a rolling direction×100 mm in a direction orthogonal to the rolling direction and then subjected to stress relief annealing (800° C., 2 hours, $N_2$ atmosphere). Subsequently, magnetic properties ($W_{17/50}$ value, $B_8$ value) of the steel sheets were measured. The measurement results were as follows: $W_{17/50}$: 0.83 W/kg, $B_8$: 1.92 T.

Then, on the steel sheets, a picosecond laser processing machine (PiCooLs) from L.P.S. Works Co., Ltd. was used to form linear grooves with various shapes listed in Table 1. At that time, an angle between a direction in which the linear groove extends and the direction orthogonal to the rolling direction of the steel sheet was set to 10°, and a mutual interval of the linear grooves was set to 3000 μm. After this groove formation, the steel sheets were subjected to stress relief annealing (800° C., 2 hours, $N_2$ atmosphere), and subsequently magnetic properties ($W_{17/50}$ value, $W_{15/60}$ value, $B_8$ value) of the steel sheets were measured. The results are listed in Table 1.

As listed in Table 1, a groove with a shape according to the disclosure allows a steel sheet to have extremely good iron loss properties such as 0.74 W/kg or less of iron loss $W_{17/50}$ in a high magnetic field and 0.71 W/kg or less of iron loss $W_{15/60}$ while keeping magnetic flux density $B_8$ equivalent to or more than a conventional steel sheet with a linear groove which floor is of the constant depth.

As used herein, $B_8$ denotes magnetic flux density in excitation at 800 A/m, $W_{17/50}$ denotes iron loss in excitation at 1.7 T of magnetic flux density and at 50 Hz of alternating current, and $W_{15/60}$ denotes iron loss in excitation at 1.5 T of magnetic flux density and at 60 Hz of alternating current.

EXAMPLE 2

Steel slabs, each containing, in mass %, Si: 3.3%, C: 0.06%, Mn: 0.08%, S: 0.001%, Al: 0.020%, N: 0.006%, Cu: 0.05%, and Sb: 0.01% were heated under conditions of 1200° C.×30 minutes, and then subjected to hot rolling to obtain hot-rolled sheets with a thickness of 2.2 mm. Then, the hot-rolled sheets were subjected to hot band annealing under conditions of 1000° C.×1 minute, then cold rolling to obtain steel sheets with a final sheet thickness of 0.27 mm. The steel sheets were then heated from room temperature to 820° C. at the heating rate of 200° C./s and subjected to primary recrystallization annealing (also serving as decarburization) in a wet $H_2$-$N_2$ atmosphere. Subsequently, an annealing separator in a water slurry state mainly composed of MgO was applied to the steel sheets and dried. The steel sheets were further subjected to final annealing of heating from 300° C. to 800° C. for 100 hours, then heating to 1200° C. at the heating rate of 50° C./h, and subjecting to annealing for 5 hours at 1200° C. Then a silicophosphate-based insulation tension coating containing a composition of aluminum phosphate (as $Al(PO_3)_3$): 25 mol %, colloidal silica (as $SiO_2$): 60 mol %, and $CrO_3$: 7 mol % was applied to the steel sheets and baked under conditions of 800° C.×1 minute. The steel sheets thus obtained were sheared into a size of 300 mm in a rolling direction×100 mm in a direction

TABLE 1

| | Measurement results of linear groove shape parameters | | | | | | | Magnetic properties | | | |
|---|---|---|---|---|---|---|---|---|---|---|---|
| | | | | | | | | Magnetic flux density | Iron loss | Iron loss | |
| No. | p (μm) | D (μm) | d (μm) | W (μm) | D/t | d/D | p/W | $B_8$ (T) | $W_{17/50}$ (W/kg) | $W_{15/60}$ (W/kg) | Remarks |
| 1 | 0 | 20 | 0 | 100 | 0.087 | 0 | 0.00 | 1.87 | 0.75 | 0.72 | Conventional Example |
| 2 | 20 | 15 | 5 | 20 | 0.065 | 0.33 | 1.00 | 1.90 | 0.68 | 0.65 | Example |
| 3 | 20 | 15 | 5 | 40 | 0.065 | 0.33 | 0.50 | 1.89 | 0.69 | 0.66 | Example |
| 4 | 20 | 15 | 5 | 100 | 0.065 | 0.33 | 0.20 | 1.88 | 0.70 | 0.68 | Example |
| 5 | 20 | 15 | 5 | 15 | 0.065 | 0.33 | 1.33 | 1.91 | 0.75 | 0.72 | Comparative Example |
| 6 | 60 | 15 | 5 | 50 | 0.065 | 0.33 | 1.20 | 1.89 | 0.70 | 0.67 | Example |
| 7 | 20 | 15 | 5 | 120 | 0.065 | 0.33 | 0.17 | 1.87 | 0.75 | 0.72 | Comparative Example |
| 8 | 30 | 10 | 10 | 40 | 0.043 | 1.00 | 0.75 | 1.91 | 0.73 | 0.71 | Example |
| 9 | 30 | 20 | 15 | 40 | 0.087 | 0.75 | 0.75 | 1.87 | 0.68 | 0.66 | Example |
| 10 | 30 | 12 | 10 | 40 | 0.052 | 0.83 | 0.75 | 1.91 | 0.68 | 0.65 | Example |
| 11 | 30 | 40 | 10 | 40 | 0.174 | 0.25 | 0.75 | 1.87 | 0.67 | 0.65 | Example |
| 12 | 30 | 50 | 10 | 40 | 0.217 | 0.20 | 0.75 | 1.85 | 0.74 | 0.70 | Example |
| 13 | 30 | 60 | 10 | 40 | 0.261 | 0.17 | 0.75 | 1.84 | 0.74 | 0.69 | Example |
| 14 | 20 | 20 | 1 | 80 | 0.087 | 0.05 | 0.25 | 1.88 | 0.75 | 0.73 | Comparative Example |
| 15 | 20 | 20 | 2 | 80 | 0.087 | 0.10 | 0.25 | 1.88 | 0.69 | 0.68 | Example |
| 16 | 5 | 20 | 5 | 5 | 0.087 | 0.25 | 1.00 | 1.91 | 0.68 | 0.66 | Example |
| 17 | 20 | 20 | 5 | 80 | 0.087 | 0.25 | 0.25 | 1.88 | 0.67 | 0.64 | Example |
| 18 | 20 | 20 | 20 | 80 | 0.087 | 1.00 | 0.25 | 1.87 | 0.65 | 0.62 | Example |
| 19 | 20 | 20 | 25 | 80 | 0.087 | 1.25 | 0.25 | 1.86 | 0.75 | 0.68 | Comparative Example |

orthogonal to the rolling direction and then subjected to stress relief annealing (800° C., 2 hours, N2 atmosphere). Subsequently, magnetic properties ($W_{17/50}$ value, $B_8$ value) of the steel sheets were measured. The measurement results were as follows: $W_{17/50}$: 0.90 W/kg, $B_8$: 1.93 T.

Then, a first-stage process was performed using a picosecond laser processing machine (PiCooLs) from L.P.S. Works Co., Ltd. to peel the forsterite film and the insulation tension coating in a dot pattern so as to obtain a shape as listed in Table 2. Then, electrolytic etching was performed, using NaCl as an electrolytic solution. Subsequently, as a second-stage process, the laser processing machine was used to peel the forsterite film and the insulation coating existing between the dots formed in the first-stage process so as to obtain a shape as listed in Table 2. Then, electrolytic etching was performed, using NaCl as an electrolytic solution.

Further, the steel sheets after groove formation were subjected to stress relief annealing (800° C., 2 hours, $N_2$ atmosphere). Then, magnetic properties of the steel sheets were measured ($W_{17/50}$ value, $W_{15/60}$ value, $B_8$ value). The results thereof are listed in Table 2.

TABLE 2

| | Measurement results of linear groove shape parameters | | | | | | | | | | Magnetic properties | | | |
|---|---|---|---|---|---|---|---|---|---|---|---|---|---|---|
| No. | p (μm) | D (μm) | d (μm) | W (μm) | D/t | d/D | p/W | Angle with a direction orthogonal to a rolling direction (°) | Groove interval l (μm) | l/W | Magnetic flux density $B_8$ (T) | Iron loss $W_{17/50}$ (W/kg) | Iron loss $W_{15/60}$ (W/kg) | Remarks |
| 1 | 0 | 20 | 0 | 100 | 0.074 | 0 | 0.00 | 10 | 3000 | 30 | 1.89 | 0.82 | 0.78 | Conventional Example |
| 2 | 20 | 15 | 5 | 20 | 0.056 | 0.33 | 1.00 | 10 | 3000 | 150 | 1.92 | 0.73 | 0.71 | Example |
| 3 | 20 | 15 | 5 | 40 | 0.056 | 0.33 | 0.50 | 0 | 3000 | 75 | 1.90 | 0.72 | 0.69 | Example |
| 4 | 20 | 15 | 5 | 40 | 0.056 | 0.33 | 0.50 | 10 | 3000 | 75 | 1.91 | 0.74 | 0.72 | Example |
| 5 | 20 | 15 | 5 | 40 | 0.056 | 0.33 | 0.50 | 20 | 3000 | 75 | 1.91 | 0.74 | 0.71 | Example |
| 6 | 20 | 15 | 5 | 40 | 0.056 | 0.33 | 0.50 | 40 | 3000 | 75 | 1.92 | 0.75 | 0.71 | Example |
| 7 | 20 | 15 | 5 | 40 | 0.056 | 0.33 | 0.50 | 50 | 3000 | 75 | 1.93 | 0.77 | 0.72 | Example |
| 8 | 5 | 15 | 5 | 5 | 0.056 | 0.33 | 1.00 | 10 | 3000 | 600 | 1.92 | 0.74 | 0.72 | Example |
| 9 | 5 | 15 | 5 | 5 | 0.056 | 0.33 | 1.00 | 20 | 2000 | 400 | 1.90 | 0.73 | 0.70 | Example |
| 10 | 5 | 15 | 5 | 10 | 0.056 | 0.33 | 0.50 | 20 | 3000 | 300 | 1.90 | 0.72 | 0.69 | Example |
| 11 | 40 | 15 | 5 | 100 | 0.056 | 0.33 | 0.40 | 10 | 3000 | 30 | 1.91 | 0.76 | 0.73 | Example |
| 12 | 40 | 15 | 5 | 120 | 0.056 | 0.33 | 0.33 | 10 | 3000 | 25 | 1.91 | 0.75 | 0.73 | Example |
| 13 | 40 | 15 | 5 | 150 | 0.056 | 0.33 | 0.27 | 10 | 3000 | 20 | 1.90 | 0.75 | 0.72 | Example |
| 14 | 40 | 15 | 5 | 200 | 0.056 | 0.33 | 0.20 | 10 | 3000 | 15 | 1.89 | 0.76 | 0.73 | Example |
| 15 | 60 | 15 | 5 | 50 | 0.056 | 0.33 | 1.20 | 25 | 1000 | 20 | 1.91 | 0.76 | 0.67 | Example |
| 16 | 20 | 15 | 5 | 120 | 0.056 | 0.33 | 0.17 | 25 | 2000 | 17 | 1.89 | 0.82 | 0.80 | Comparativel Example |
| 17 | 30 | 10 | 10 | 40 | 0.037 | 1.00 | 0.75 | 25 | 1000 | 25 | 1.92 | 0.80 | 0.75 | Example |
| 18 | 30 | 20 | 10 | 40 | 0.074 | 0.50 | 0.75 | 25 | 1000 | 25 | 1.90 | 0.68 | 0.66 | Example |
| 19 | 30 | 15 | 10 | 40 | 0.056 | 0.67 | 0.75 | 25 | 400 | 10 | 1.92 | 0.68 | 0.65 | Example |
| 20 | 20 | 20 | 1 | 80 | 0.074 | 0.05 | 0.25 | 30 | 2500 | 31 | 1.90 | 0.81 | 0.77 | Comparativel Example |
| 21 | 20 | 20 | 2 | 80 | 0.074 | 0.10 | 0.25 | 30 | 2500 | 31 | 1.90 | 0.76 | 0.68 | Example |
| 22 | 20 | 60 | 15 | 80 | 0.222 | 0.25 | 0.25 | 30 | 2500 | 31 | 1.86 | 0.80 | 0.75 | Example |
| 23 | 20 | 20 | 20 | 80 | 0.074 | 1.00 | 0.25 | 30 | 2500 | 31 | 1.90 | 0.74 | 0.71 | Example |
| 24 | 20 | 20 | 25 | 80 | 0.087 | 1.25 | 0.25 | 30 | 2500 | 31 | 1.87 | 0.81 | 0.76 | Comparativel Example |

As listed in Table 2, a groove with a shape according to the disclosure allows a steel sheet to have extremely good iron loss properties such as 0.80 W/kg or less of iron loss $W_{17/50}$ in a high magnetic field and 0.75 W/kg or less of iron loss $W_{15/60}$ while keeping magnetic flux density $B_8$ equivalent to or more than a conventional steel sheet with a linear groove which floor is of the constant depth.

REFERENCE SIGNS LIST

1 steel sheet
2 linear groove
3 recessed part
l mutual interval of linear grooves
W opening width of a linear groove
t thickness of a steel sheet
D depth of a linear groove
d depth of a recessed part
p interval of recessed parts

The invention claimed is:

1. A grain-oriented electrical steel sheet, comprising magnetic domains refined by a plurality of linear grooves in a surface of a steel sheet, wherein each of the linear grooves has an opening width W (mm) over a direction in which the linear groove extends, wherein each of the linear grooves has on only a part of its floor a plurality of recessed parts aligned in the direction in which the linear groove extends, at an interval p (mm) which satisfies the following Formula (1):

$$0.20\,W \le p \le 1.20\,W \quad (1),$$

and wherein the recessed part has a depth d (mm) which satisfies the following Formula (2):

$$0.10\,D \le d \le 1.00\,D \quad (2),$$

where D is an average depth of the linear groove (μm), which is determined by observing a cross-section taken along a direction in which the linear groove extends along a 1 mm length thereof, measuring a cross-sectional area of the grooves comprising the recessed parts in the cross-section, and dividing the cross-sectional area by 1 mm, and where the depth d (μm) of the recessed part is determined by observing the cross-section and subtracting the average depth D from an average depth of the deepest part of each recessed part.

2. The grain-oriented electrical steel sheet according to claim 1, wherein the average depth D (mm) of the linear groove satisfies the following Formula (3):

$$0.05\ t \leq D \leq 0.20\ t \quad (3),$$

where t is a steel sheet thickness (mm).

3. The grain-oriented electrical steel sheet according to claim 2, wherein the direction in which the linear groove extends forms an angle of 0° or more and 40° or less with a direction orthogonal to a rolling direction of the steel sheet.

4. The grain-oriented electrical steel sheet according to claim 3, wherein the linear grooves have a mutual interval 1 (mm) in the rolling direction of the steel sheet which satisfies the following Formula (4):

$$10\ W \leq 1 \leq 400\ W \quad (4),$$

where W is an opening width of the linear groove (mm).

5. The grain-oriented electrical steel sheet according to claim 4, wherein the opening width W of the linear groove is 5 mm or more and 150 mm or less.

6. The grain-oriented electrical steel sheet according to claim 3, wherein the opening width W of the linear groove is 5 mm or more and 150 mm or less.

7. The grain-oriented electrical steel sheet according to claim 2, wherein the linear grooves have a mutual interval 1 (mm) in the rolling direction of the steel sheet which satisfies the following Formula (4):

$$10\ W \leq 1 \leq 400\ W \quad (4),$$

where W is an opening width of the linear groove (mm).

8. The grain-oriented electrical steel sheet according to claim 7, wherein the opening width W of the linear groove is 5 mm or more and 150 mm or less.

9. The grain-oriented electrical steel sheet according to claim 2, wherein the opening width W of the linear groove is 5 mm or more and 150 mm or less.

10. The grain-oriented electrical steel sheet according to claim 1, wherein the direction in which the linear groove extends forms an angle of 0° or more and 40° or less with a direction orthogonal to a rolling direction of the steel sheet.

11. The grain-oriented electrical steel sheet according to claim 10, wherein the linear grooves have a mutual interval 1 (mm) in the rolling direction of the steel sheet which satisfies the following Formula (4):

$$10\ W \leq 1 \leq 400\ W \quad (4),$$

where W is an opening width of the linear groove (mm).

12. The grain-oriented electrical steel sheet according to claim 11, wherein the opening width W of the linear groove is 5 mm or more and 150 mm or less.

13. The grain-oriented electrical steel sheet according to claim 10, wherein the opening width W of the linear groove is 5 mm or more and 150 mm or less.

14. The grain-oriented electrical steel sheet according to claim 1, wherein the linear grooves have a mutual interval 1 (mm) in the rolling direction of the steel sheet which satisfies the following Formula (4):

$$10\ W \leq 1 \leq 400\ W \quad (4),$$

where W is an opening width of the linear groove (mm).

15. The grain-oriented electrical steel sheet according to claim 14, wherein the opening width W of the linear groove is 5 mm or more and 150 mm or less.

16. The grain-oriented electrical steel sheet according to claim 1, wherein the opening width W of the linear groove is 5 mm or more and 150 mm or less.

* * * * *